US005478253A

United States Patent [19]

Biechler et al.

[11] Patent Number: 5,478,253

[45] Date of Patent: Dec. 26, 1995

[54] ELECTROSTATIC DISCHARGE CONTACTS FOR BLIND MATING CONNECTORS

[75] Inventors: Donald T. Biechler; Robert W. Walker; Earl C. Myers, Jr., all of Harrisburg; Robert N. Whiteman, Jr., Middletown, all of Pa.

[73] Assignee: The Whitaker Corporation, Wilmington, Del.

[21] Appl. No.: 310,027

[22] Filed: Sep. 21, 1994

[51] Int. Cl.[6] ..... H01R 13/652

[52] U.S. Cl. ..... 439/181; 439/108; 439/567

[58] Field of Search ..... 439/83, 101, 108, 439/181, 733.1, 571, 572, 567, 607

[56] References Cited

U.S. PATENT DOCUMENTS 4,425,015 1/1984 Rizzo ..... 439/83
4,842,543 6/1989 Davis ..... 439/378
4,904,194 2/1990 Kilsdonk et al. ..... 439/101
5,238,413 8/1993 McCaffrey et al. ..... 439/79
5,356,300 10/1994 Costello et al. ..... 439/101

*Primary Examiner*—Gary F. Paumen

[57] ABSTRACT

An electrostatic discharge contact (70) comprises a proximal portion (72), a distal portion (74), and substantially flat outside (76) and inside surfaces (78) extending therebetween. Retention dimples (80) are disposed in spaced-apart relation on the proximal portion (72) of the outside surface (76). The retention dimples (80) are adapted to engage a corresponding cavity (100) in an insulative connector housing (15). An arm (82) extends away from proximal portion (72) of the electrostatic discharge contact (70). The arm (82) includes a rounded distal end (86) that is adapted to electrically engage a portion of a board mount (130) that is already assembled to the electrical connector (10).

7 Claims, 5 Drawing Sheets

ELECTROSTATIC DISCHARGE CONTACTS FOR BLIND MATING CONNECTORS

FIELD OF THE INVENTION

This invention generally relates to electrical connector assemblies suitable for blind mating applications, and more particularly to a first-mate electrostatic discharge protection feature for the same.

BACKGROUND OF THE INVENTION

U.S. Pat. No. 4,842,543 teaches an electrical connector having an insulating housing including a mating face for engaging another mating connector. Electrical contacts are disposed in the housing and extend toward the mating face. Posts project beyond the mating face to protect the contacts from being damaged. The posts align the mating face of the connector with another mating electrical connector, prior to the connection of the two electrical connectors. The posts provide protection to the contacts without providing a ground connection to an electrical terminal in the connector.

U.S. Pat. No. 4,904,194 teaches grounding pins that project from an electrical connector. The grounding pins incorporate springs that bias the grounding pins sideways against side portions of sockets disposed in another mating electrical connector. The grounding pins establish a ground connection between the connector and a mating electrical connector without establishing a ground connection to an electrical terminal in the mating electrical connector.

U.S. Pat. No. 5,238,413 teaches an electrical connector that includes an insulative housing and a board mount adapted for fastening the electrical connector to a printed circuit board. The board mount provides mechanical interconnection between the electrical connector and the printed circuit board, but without establishing an electrical pathway to ground from a mating electrical connector.

Blind mating electrical connectors, such as those suitable for connecting a computer disk drive to a docking work station, are well known. Typically, the entire disk drive is inserted into a docking opening in a work station. This usually requires the connector on the disk drive to be capable of aligning with a mating electrical connector in the docking opening, but without the benefit of direct visual confirmation to the installer. This is accomplished through the provision of alignment posts on the connector that project beyond its mating face. The alignment posts align the mating face with the mating electrical connector prior to full connection.

The disk drive is connected to the active circuits in a docking work station upon full insertion of the drive into a docking opening. Arcing, due to electrostatic discharge, may occur when a connector on the disk drive is connected to the active circuits. Arcing due to electrostatic discharge often has a deleterious effect on the active components associated with the disk drive.

SUMMARY OF THE INVENTION

The present invention provides an electrical connector having at least one electrostatic discharge contact located within an alignment post receiving socket of the connector. The electrostatic discharge contact is adapted to slidingly engage a corresponding ground contact that is located on at least one alignment post disposed on a corresponding mating connector.

In a preferred embodiment, the electrostatic discharge contact slidingly engages the ground contact prior to any physical or electrical connection between the other electrical contacts disposed in either electrical connector. Thus the electrostatic discharge contact of the present invention receives any electrostatic charge build-up first, and safely channels that electrostatic charge to circuit ground potential. As a result of this construction, the present invention provides protection to the active circuit components.

According to a feature of the present invention, the electrostatic discharge contact comprises proximal and distal portions having a substantially flat outside and inside surfaces extending therebetween. Retention dimples are disposed in spaced-apart relation on the proximal portion of the outside surface. The retention dimples are adapted to protrude from the inside surface so as to engage a corresponding cavity in an insulative connector housing. An arm extends away from a proximal portion of the electrostatic discharge contact. The arm includes a rounded distal end that is adapted to electrically engage a portion of a board mount that is already assembled to the connector. The electrostatic discharge contact of the present invention further includes insertion guidance and alignment portions that are disposed on its peripheral edges. The insertion guidance and alignment portions are adapted to facilitate the positioning of the electrostatic discharge contact in the corresponding cavity.

An objective of the invention is to provide an electrical connector with electrostatic discharge contacts that will discharge electrostatic energy to circuit ground potential prior in sequence to the connection of other electrical contacts.

Another objective of the invention is to provide an electrical connector assembly having a first electrical connector that includes alignment posts and ground contacts in the alignment posts, both of which project beyond a mating face of the connector, and a second mating connector that includes electrostatic discharge contacts adapted to engage the ground contacts prior to engagement of any other electrical contacts in the assembly.

Another objective of the invention is to provide an electrical connector assembly wherein a first electrical connector is provided with alignment posts and ground contacts in the alignment posts, both of which project beyond a mating face of the connector, and another mating electrical connector is provided with alignment post receiving sockets and electrostatic discharge contacts within those sockets, and further wherein board mounts are disposed in electrical engagement with the electrostatic discharge contacts so as to provide a pathway to circuit ground potential.

Embodiments of the invention will now be described, by way of example, with reference being made to the accompanying drawings wherein like numerals refer to like parts and further wherein:

DETAILED DESCRIPTION OF THE PREFERRED EMBODIMENT

Figure 1:
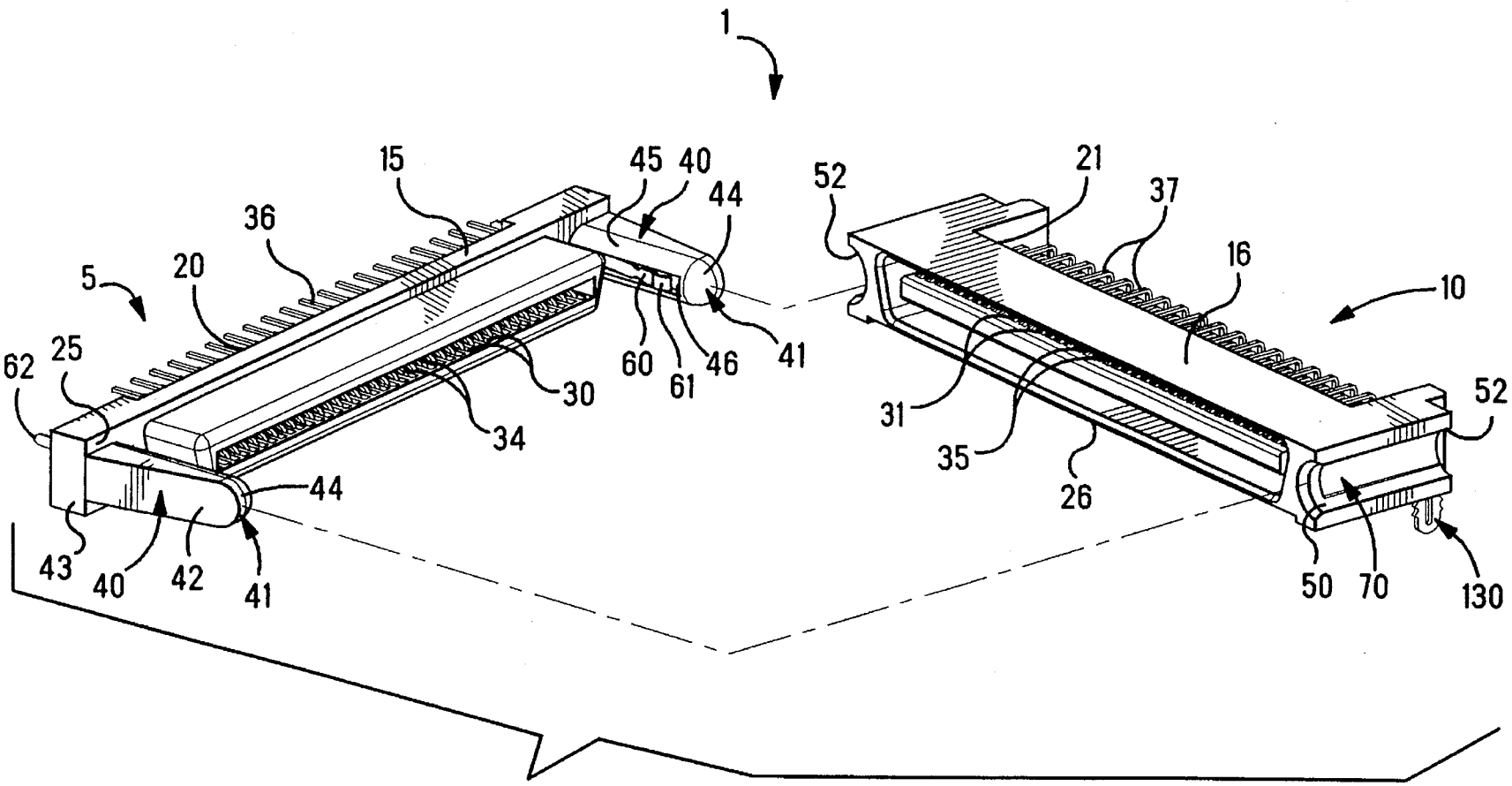
FIG. 1 is a perspective view of one embodiment of an electrical connector assembly comprising a first electrical connector and a mating electrical connector, with ground contacts extending along alignment posts disposed on the first electrical connector and with the electrostatic discharge contacts shown within alignment post receiving sockets disposed in the mating electrical connector.

Now referring to FIG. 1, the electrostatic discharge contact of the present invention is used in combination with an electrical connector assembly 1 comprising a first electrical connector 5 and a second mating electrical connector 10.

More particularly, each electrical connector 5,10 comprises, an insulating housing 15,16 and a plurality of electrical contacts 34,35. Each insulating housing 15,16 includes a rear face 20,21, a mating face 25,26, and a plurality of contact receiving cavities 30,31. Contact receiving cavities 30,31 extend through insulating housing 15,16 from rear face 20,21 to mating face 25,26.

Electrical connector 5 complements mating connector 10 in that it further comprises insulative alignment posts 40. Alignment posts 40 are disposed in spaced-apart relation on insulating housing 15 and project outwardly beyond mating face 25. Alignment posts 40 facilitate blind mating connection of electrical connectors 5 and 10.

More particularly, each alignment post 40 is tapered forwardly toward a forward tip 41. A flat surface 42, disposed on each alignment post 40, merges with a flat end 43 of electrical connector 5. Flat surface 42 is inclined forwardly along the length of each alignment post 40 to tips 41. Inclined flat surface 42 merges with a bulbous, rounded end surface 44 disposed on each tip 41. An inward facing surface 45 of each alignment post 40 is rounded and merges with flat surface 42. Inward facing surfaces 45 face each other, and are adapted to engage alignment post receiving sockets 50 that are laterally disposed in spaced-apart relation on electrical connector 10. In this way, alignment posts 40 project outwardly and cooperate with alignment post receiving sockets 50 so as to align the mating faces 25 of both electrical connectors 5 and 10 while they are spaced apart from each other. Ground contact receiving cavities 46 are disposed within inward facing surfaces 45 for receiving ground contacts 60, as will hereinafter be disclosed in further detail.

Figure 5:
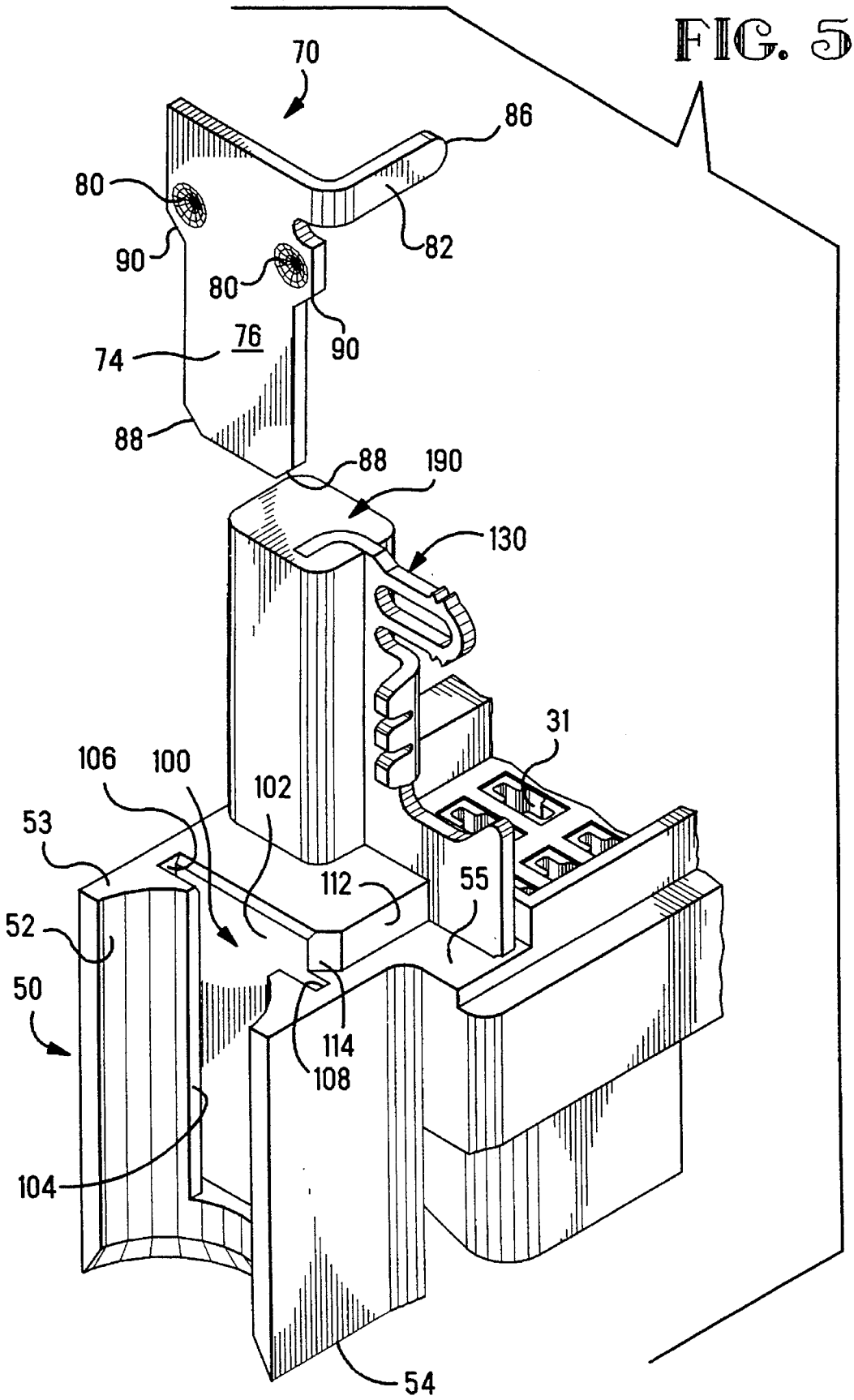
FIG. 5 is a broken away, partially exploded perspective view of another embodiment of the connector shown in FIG. 1, showing an electrostatic discharge contact prior to assembly.

Referring now to FIGS. 1 and 5, alignment post receiving sockets 50 comprise semi-circular channels 52 (FIG. 5) that extend between a first surface 53 and a second surface 54 and are disposed on each lateral side of mating electrical connector 10 (FIG. 1). Alignment post receiving sockets 50 are spaced apart to correspond with the spacing between tips 41 of alignment posts 40.

These features of electrical connectors 5 and 10 can be applied to various other connector assembly types, not shown, for forming a blind mating connection. In the present invention, alignment posts 40 and alignment post receiving sockets 50 are further adapted to provide a pathway to circuit ground potential for electrostatic energy, as will hereinafter be disclosed in further detail.

Figure 6:
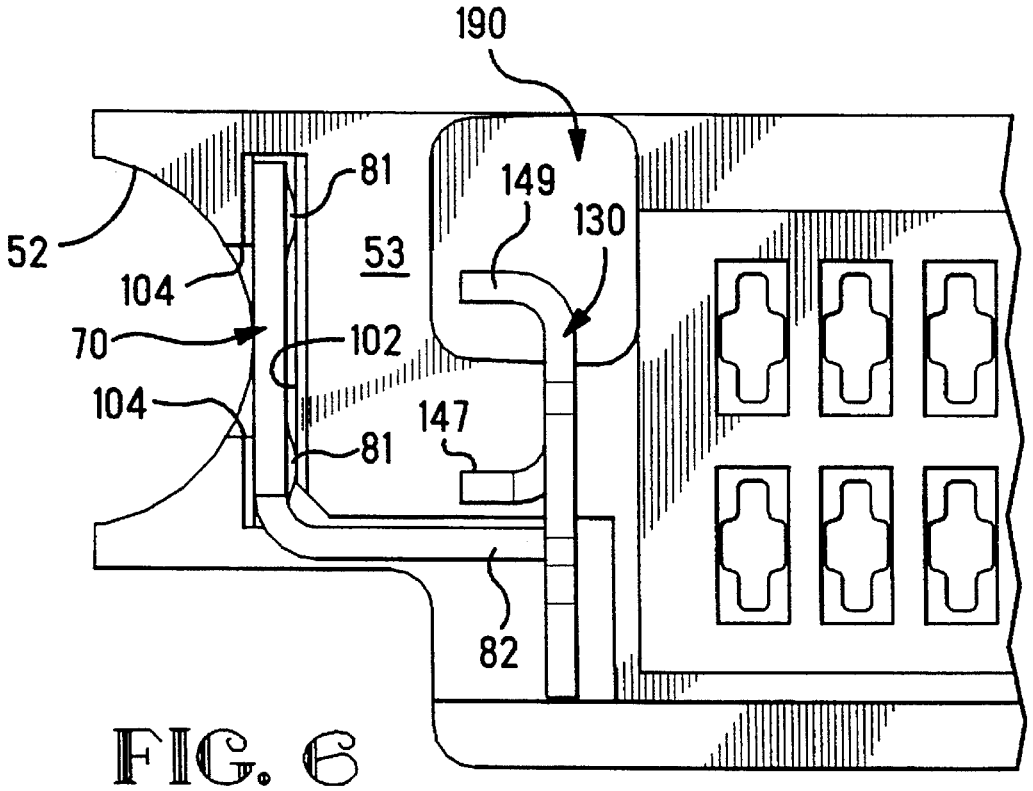
FIG. 6 is a top, broken away view of the embodiment of the connector shown in FIG. 5.
Figure 7:
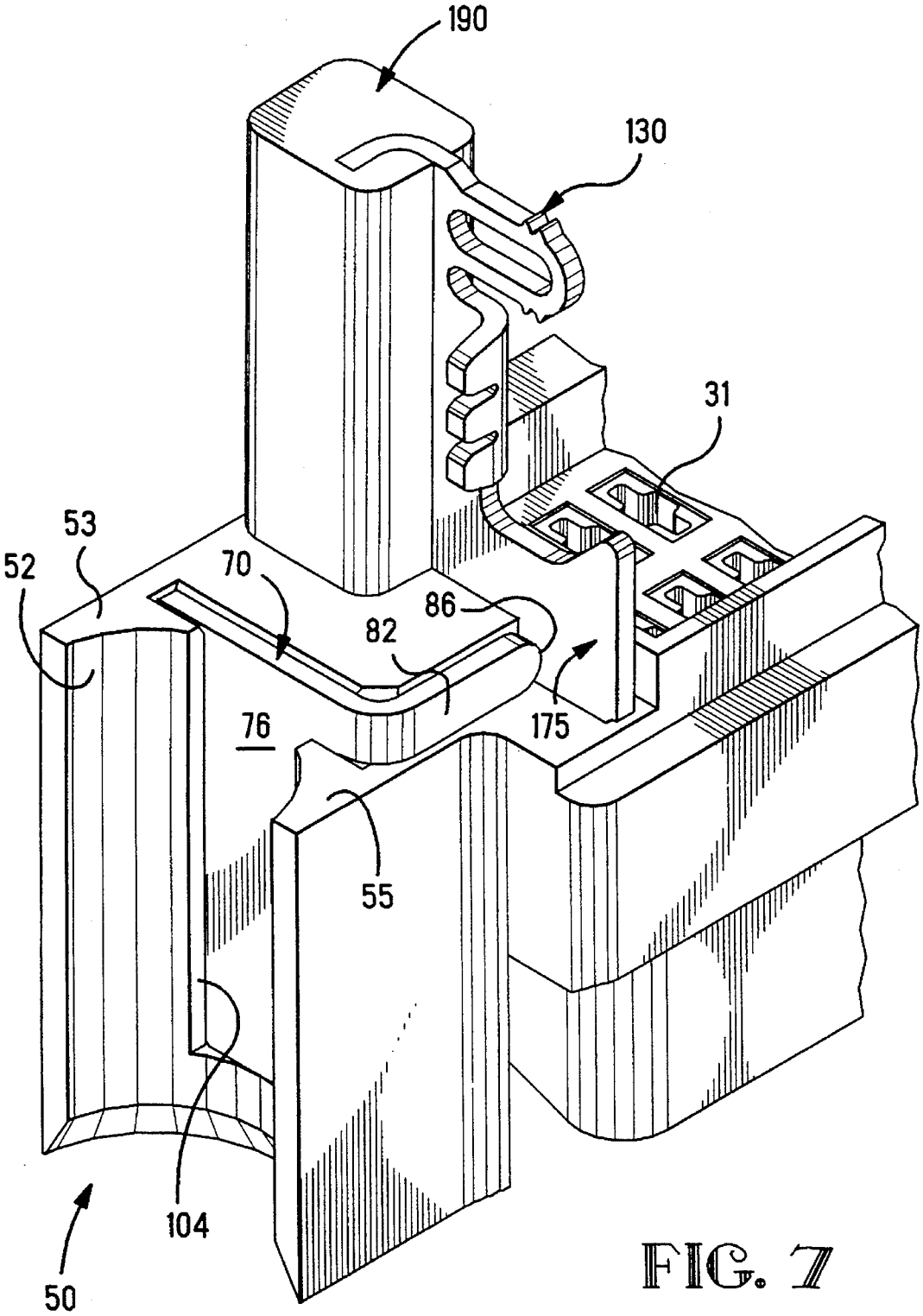
FIG. 7 is a broken away perspective view of the embodiment of the connector illustrated in FIG. 5, showing the electrostatic discharge contact fully assembled in the connector housing.

Electrical contacts 34,35 (FIG. 1) are disposed in, and extend through contact receiving cavities 30,31 (FIGS. 1, 6 and 7). Electrical contacts 34,35 further include electrical terminals 36,37 that project from rear faces 20,21 of insulating housings 15,16 for connection to a printed circuit board, not shown. Electrical contacts 34,35 may comprise the same, similar, or distinct groupings of electrical contacts.

Electrical connector 5 also comprises electrical ground contacts 60 (FIG. 1) extending in and through ground contact receiving cavities 46. Ground contacts 60 are positioned along inward facing surface 45 of alignment posts 40. Ground contacts 60 are longer than the electrical contacts 34, and extend through insulating housing 15 of electrical connector 5.

Ground contacts 60 are stamped and formed from a blank of conductive metal and may have an electroplated conductive metal deposited on their outwardly facing surfaces. Each ground contact 60 includes a curved contact surface 61. Each curved contact surface 61 projects outwardly from inward facing surfaces 45 of alignment posts 40 (FIG. 1) so as to be in position to engage an electrostatic discharge contact on electrical connector 10, as will hereinafter be disclosed in further detail.

Electrical terminals 62 on ground contacts 60 project from rear face 20 of electrical connector 5 for connection to a printed circuit board (not shown). Alignment posts 40 and associated ground contacts 60 project outwardly beyond mating face 25 so as to enable a ground connection to be made with mating connector 10 prior in sequence to any other electrical connection, as will hereinafter be disclosed in further detail.

Now referring to FIGS. 1–8, mating electrical connector 10 further comprises electrostatic discharge contacts 70 (FIGS. 2 and 4), cavities 100 (FIG. 5,), and board mounts 130 (FIGS. 5, 6, 7 and 8).

Figure 4:
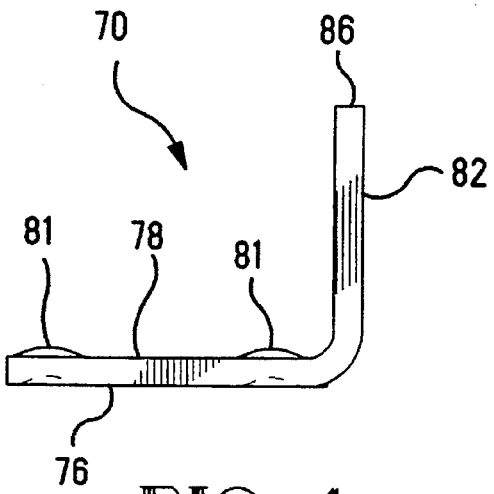
FIG. 4 is a top view of the electrostatic discharge contact of the present invention, as taken along line 4—4 in FIG. 2.
Figure 2:
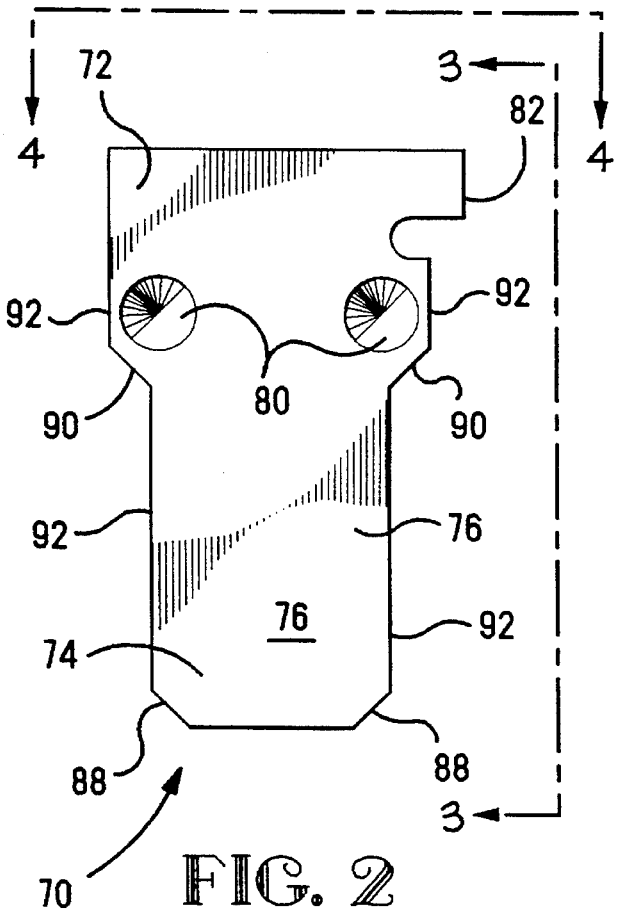
FIG. 2 is a front plan view, in elevation, of the electrostatic discharge contact of the present invention.
Figure 3:
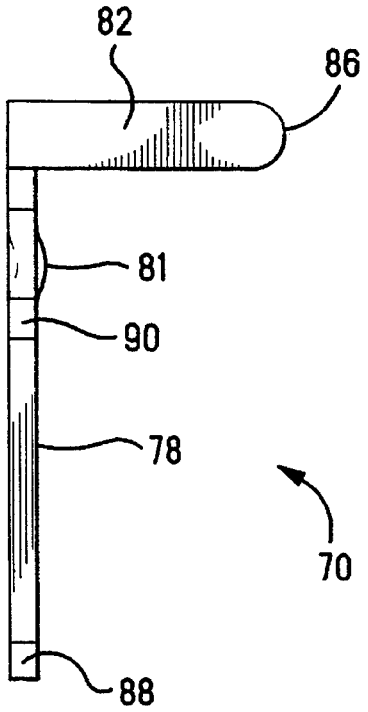
FIG. 3 is a side view, in elevation, of the electrostatic discharge contact of the present invention, as taken along line 3—3 of FIG. 2.

More particularly, and now referring to FIGS. 2–4, each electrostatic discharge contact 70 comprises a proximal portion 72 and a distal portion 74. A substantially flat outside surface 76 and a substantially flat inside surface 78 extend between proximal portion 72 and distal portion 74. Each electrostatic discharge contact 70 is stamped and formed from a blank of conductive metal and may have an electroplated conductive metal deposited on its surfaces Retention dimples 80 are disposed in spaced-apart relation on proximal portion 72 of electrostatic discharge contact 70. Retention dimples 80 include rounded interference portions 81 that protrude from flat inside surface 78 (FIG. 3) so as to engage a corresponding surface of a cavity 100, as will hereinafter be disclosed in further detail.

An arm 82 extends away from proximal portion 72 of electrostatic discharge contact 70. Arm 82 has a substantially rectangular cross-section and includes a rounded distal end portion 86 that is adapted to electrically engage a portion of a board mount 130, as will hereinafter be disclosed in further detail. Arm 82 is normally bent approximately 90 degrees with respect to inside surface 78 (FIG. 4).

Electrostatic discharge contact 70 further includes insertion guidance portions 88 disposed in spaced-apart relation on distal portion 74. Insertion guidance portions 88 comprise chamfered corners that provide lead-in to help guide electrostatic discharge contact 70 into cavity 100 during assembly. Alignment portions 90 are disposed in spaced-apart relation on peripheral edge 92 and are adapted to maintain the orientation of electrostatic discharge contact 70 in cavity 100.

Referring now to FIGS. 5, 6, and 7, each cavity 100 is disposed in an inner portion of each alignment post receiving socket 50. Each cavity 100 comprises a generally rectangular opening located at the base of semi-circular channel 52. Each cavity 100 comprises a back surface 102, a slotted front wall 104, and side edges 106 and 108.

Arm positioning surface 112 (FIG. 5) extends between first surface 53 of alignment post receiving socket 50 and surface 55. Arm positioning surface 112 extends to board mount 130 so as to help guide arm 82 into electrical engagement with board mount 130, as will hereinafter be disclosed in further detail. Arm positioning surface 112 further includes a chamfered corner portion 114 that is adapted to accept the right angled portion of arm 82.

Figure 8:
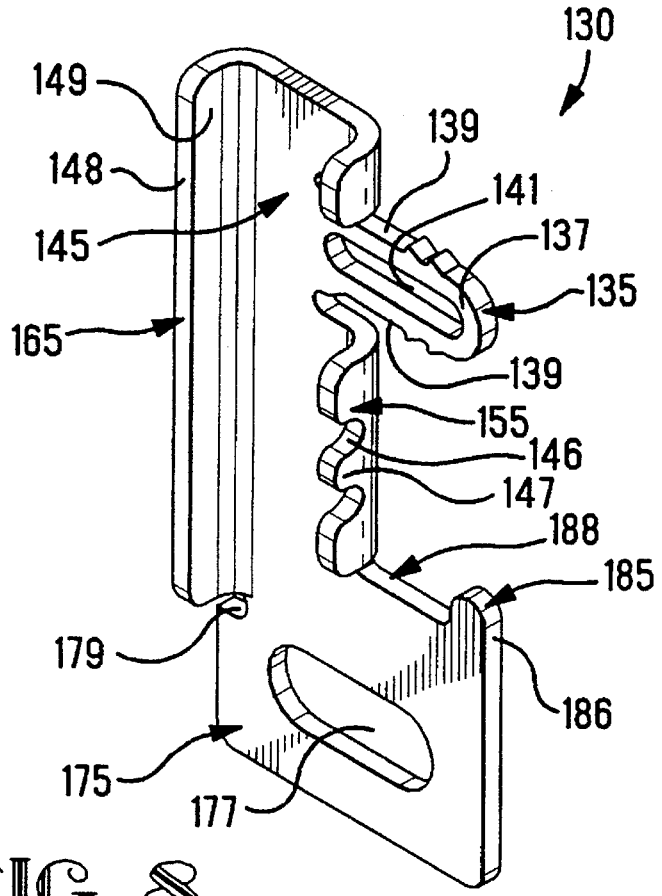
FIG. 8 is a perspective view of a board mount used in connection with the present invention.

In the preferred embodiment of the present invention, an electrical pathway to circuit ground potential is provided by electrostatic discharge contact 70 via the electrical and mechanical engagement of arm 82 with board mount 130. Referring now to FIG. 8, board mount 130 comprises a board lock 135, a web 145, a first flange 155, a second flange 165, an anchor fluke 175, and a hook 185.

More particularly, board lock 135 comprises a slotted post 137 that is coplanar with web 145. Barbed spring members 139 extend along opposite sides of a closed slot 141 and are joined together at each end. Slotted post 137 is adapted for insertion into an aperture of a printed circuit board (not shown). Slotted post 137 is dimensioned so as to create an interference fit within the printed circuit board aperture. Further details of slotted post 137 and its interaction with a printed circuit board aperture are taught in U.S. Pat. No. 4,907,987, which is incorporated herein by reference.

Web 145 extends in transverse coplanar relation to slotted post 137. Web 145 includes a first edge 146 defining a first flange 147, and a second edge 148 defining a second flange 149 (FIG. 8). First edge 146 defines the periphery of both slotted post 137 and first flange 147. First flange 147 is bent outwardly of the plane of web 145 and is transverse thereto. First edge 146, along first flange 147, has a wavy shape for amassing molten solder, and for distributing the molten solder along the surface of first flange 147. In this way, first flange 147 is adapted for engaging a solder pad located on the printed circuit board's surface. Typically, molten solder is used to join first flange 147 to the solder pad by various methods that are well known in the art.

Second flange 149, defined by second edge 148, is turned outwardly of the plane of web 145. Second flange 149 extends the length of web 145, in transverse relation to slotted post 137, so as to provide a force distribution surface. Second flange 149 acts as a pressure plate, distributing the force associated with inserting slotted post 137 into an aperture in the printed circuit board.

Anchor fluke 175 is disposed in coplanar contiguous relation with web 145 and extends outwardly therefrom. An opening 177 extends through anchor fluke 175 to maintain anchor fluke 175 in position in insulative housing 16 of electrical connector 10 upon assembly thereto, as will hereinafter be disclosed in further detail. A notch 179 is formed at an intersection of the second flange 149 and anchor fluke 175.

Hook 185 extends from an upper portion 186 of anchor fluke 175. A printed circuit board receiving space 188, equal to the thickness of the printed circuit board, is disposed between hook 185 and first flange 147. Printed circuit board receiving space 188 is adapted to receive an edge of the printed circuit board, between hook 185 and first flange 147.

Looking again at FIGS. 5, 6, and 7, board mount 130 is typically assembled, via insert molding, to insulative housing 16 during fabrication. In this way, insulative housing 16 of electrical connector 10 is molded with an internal portion of insulative housing 16 extending through opening 177 of anchor fluke 175. Thus, board mount 130 is securely anchored to insulative housing 16.

In the preferred embodiment shown in FIGS. 5, 6, and 7, a finger 190 projects outwardly and away from first surface 53 of insulative housing 16. Finger 190 is wider than second flange 149 of board mount 130 and is positioned rearwardly of cavity 100. Finger 190 is substantially rectangular in cross-section and provides mechanical support for board mount 130. In particular, board mount 130 is encased within finger 190 so as to provide web 145, first flange 147, and slotted post 137 mechanical stability while projecting from first surface 53.

Referring now to FIG. 5, electrostatic discharge contact 70 is assembled to electrical connector 10 in the following manner. Distal portion 74 of electrostatic discharge contact 70 is positioned directly above cavity 100. As seen in FIGS. 5 and 6, arm 82 extends rearwardly toward the exposed portion of anchor fluke 175 of board mount 130.

As electrostatic discharge contact 70 is inserted into cavity 100, arm 82 mechanically and electrically engages the portion of anchor fluke 175 that extends above surface 55 (FIGS. 6 and 7). More particularly, rounded distal end portion 86 slidingly engages the surface of anchor fluke 175 as electrostatic discharge contact 70 slides into cavity 100. Once electrostatic discharge contact 70 is fully inserted, arm 82 comes to rest on surface 55. Cavity 100 is positioned with respect to board mount 130 so that arm 82 is maintained in mechanical and electrical engagement against the surface of anchor fluke 175.

At the same time, rounded interference portions 81 of retention dimples 80 (FIGS. 3 and 4) engage back surface 102 of cavity 100. Electrostatic discharge contact 70 is maintained in alignment within electrostatic contact receiving cavity 100 by insertion guidance portions 88 and alignment portions 90. When electrostatic discharge contact 70 is fully inserted into cavity 100, flat outside surface 76 is exposed through slotted front wall 104 (FIG. 7).

Typically, electrical connector assembly 1 (FIG. 1) is interconnected by first aligning the respective connectors 5 and 10. This is accomplished by viewing along alignment posts 40 to target where they will align with alignment post receiving sockets 50. Mating electrical connector 10 is often completely hidden from view inside a computer chassis, not shown. Thus, alignment posts 40 are required to enter the computer chassis through an opening therein without the benefit of visually guiding them to alignment post receiving sockets 50.

As electrical connector 5 approaches electrical connector 10, but before electrical contacts 34,35 engage, tips 41 of alignment posts 40 enter alignment post receiving sockets 50. Once alignment posts 40 enter alignment post receiving sockets 50, curved contact surface 61 of ground contact 60 slidingly engages outside surface 76 of electrostatic discharge contact 70 through slotted front wall 104. It should be noted that ground contact 60 electrically engages electrostatic discharge contact 70 well in advance of any electrical interaction between electrical contacts 34,35. Any electrostatic charge that has built up between electrical connectors 5 and 10 will thus be dissipated through arm 82 to board mount 130 and consequently to circuit ground potential.

Other embodiments, features and advantages of the invention are intended to be covered by the spirit and scope of the appended claims.

What is claimed is:

1. An electrical connector comprising: an insulating housing comprising a mating face and a rear face and including a plurality of electrical contacts disposed in said housing, said plurality of electrical contacts being adapted to extend from at least said rear face to at least said mating face, said insulating housing further including two sockets positioned in spaced-apart relation on lateral sides of said insulating housing, said sockets each including a contact receiving cavity positioned within an inboard portion of said socket; and an electrostatic discharge contact located within each of said contact receiving cavities, each said electrostatic discharge contact comprising;

a proximal portion and a distal portion and having a substantially flat outside and a substantially flat inside surface extending therebetween;

retention dimples disposed in spaced-apart relation on said proximal portion of said outside surface, said retention dimples being adapted to engage a corresponding surface in a receiving cavity in an insulating housing; and an arm extending away from said proximal portion, said arm including a rounded distal end adapted to electrically engage a portion of a board mount disposed in said insulating housing.

2. An electrical connector according to claim 1 wherein said board mount comprises:

a web having a first edge defining a periphery of a mounting post and a first flange extending in transverse coplanar relation to said mounting post, said first flange being adapted for engaging a circuit board;

a second edge on said web defining a second flange turned out from the plane of said web, said second flange extending in transverse relation to said mounting post, said second flange extending over said mounting post so as to provide a force receiving pressure plate on which an insertion force is applied to insert said mounting post in an aperture of a circuit board; and an anchor fluke connected to said web for fastening said board mount in said insulating housing, a portion of said anchor fluke being disposed in electrical engagement with said arm.

3. An electrical connector assembly comprising:

a first electrical connector comprising: an insulating housing having a mating face for connection with a second mating electrical connector;

a plurality of electrical contacts disposed in said insulating housing and extending from a rear face toward said mating face;

insulating posts disposed in spaced-apart relation on the lateral sides of said insulating housing and further comprising conductive ground contacts extending along said insulating posts, said posts and said ground contacts projecting outwardly beyond said mating face to establish a ground connection of said ground contacts with said second mating electrical connector at a location spaced apart from said mating face, and to align said mating face while said mating face is spaced apart from said second mating electrical connector; and said second mating electrical connector comprising: an insulating housing comprising a mating face and a rear face and including a plurality of electrical contacts disposed in said housing, said plurality of electrical contacts being adapted to extend from at least said rear face to at least said mating face, said insulating housing further including two sockets positioned in spaced-apart relation on lateral sides of said insulating housing, said sockets each including a contact receiving cavity positioned within an inboard portion of said socket; and an electrostatic discharge contact located within each of said contact receiving cavities, each said electrostatic discharge contact comprising;

a proximal portion and a distal portion and having a substantially flat outside and a substantially flat inside surface extending therebetween;

retention dimples disposed in spaced-apart relation on said proximal portion of said outside surface, said retention dimples being adapted to engage a corresponding surface in a receiving cavity in an insulating housing; and an arm extending away from said proximal portion, said arm including a rounded distal end adapted to electrically engage a portion of a board mount disposed in said insulating housing.

4. An electrical connector assembly according to claim 3 wherein said first electrical connector further comprises inwardly facing surfaces on said posts and having said ground contacts disposed along said inwardly facing surfaces of said posts.

5. An electrical connector assembly according to claim 3, wherein said board mount comprises: a web having a first edge defining a periphery of a mounting post and a first flange extending in transverse coplanar relation to said mounting post, said first flange being adapted for engaging a circuit board; a second edge on said web defining a second flange turned out from the plane of said web, said second flange extending in transverse relation to said post, said second flange extending over said post so as to provide a force receiving pressure plate on which an insertion force is applied to insert said post in an aperture of a circuit board; and an anchor fluke connected to said web for fastening said board mount in said insulating housing, said anchor fluke disposed in electrical engagement with said arm.

6. An electrical connector assembly according to claim 5 further wherein said plurality of electrical contacts and said ground contacts in said first electrical connector are arranged so that said ground contacts extend beyond said mating face and are longer than said electrical contacts, and further wherein said insulating posts partially surround portions of said ground contacts, with said ground contacts projecting outwardly beyond said mating face to engage said electrostatic discharge contacts of said second mating electrical connector while said posts engage said sockets.

7. An electrical connector assembly according to claim 5 wherein said plurality of electrical contacts in said first electrical connector engage said corresponding plurality of electrical contacts in said second mating electrical connector subsequent in sequence to engagement of said ground contacts and said electrostatic discharge contacts.

* * * * *